US008550096B2

(12) United States Patent
Irving et al.

(10) Patent No.: US 8,550,096 B2
(45) Date of Patent: Oct. 8, 2013

(54) LOCK-IN COSMETIC ACCESSORY SLEEVE APPARATUS

(76) Inventors: Katie Marguerite Irving, New Paltz, NY (US); Timothy Martin Irving, Otisville, NY (US)

( * ) Notice: Subject to any disclaimer, the term of this patent is extended or adjusted under 35 U.S.C. 154(b) by 201 days.

(21) Appl. No.: 12/927,748

(22) Filed: Nov. 23, 2010

(65) Prior Publication Data

US 2012/0125362 A1 May 24, 2012

(51) Int. Cl.
*A45D 40/24* (2006.01)
*B05C 1/00* (2006.01)
*B43K 27/02* (2006.01)

(52) U.S. Cl.
USPC ..... 132/318; 132/317; 401/17; 401/18

(58) Field of Classification Search
USPC ..... 132/318, 320, 317, 314, 316; 401/17, 401/18, 19, 16, 23–25, 34
See application file for complete search history.

(56) References Cited

U.S. PATENT DOCUMENTS 2,710,614 A * 6/1955 Dulberg ..... 132/318
3,043,316 A * 7/1962 Bolser ..... 401/17
3,592,202 A * 7/1971 Jones ..... 132/313
3,690,777 A * 9/1972 Costa ..... 401/17
4,840,511 A 6/1989 Fattori et al.
5,492,248 A 2/1996 Ortner
5,586,694 A 12/1996 Breidenbach et al.
6,241,408 B1 * 6/2001 Lang ..... 401/17
6,276,853 B1 * 8/2001 Breidenbach et al. ..... 401/34
6,637,963 B2 * 10/2003 Huang ..... 401/19
6,702,494 B2 * 3/2004 Dumler et al. ..... 401/17

OTHER PUBLICATIONS

Mark. Magalog 12 '10 Campaigns 24 & 25, Mark. 1251 Avenue of the Americas, NY, NY, 10020, Copyright 2010 Avon Products, Inc. No. 77513-9, pp. 7, 30-33.

* cited by examiner

*Primary Examiner* — Robyn Doan
(74) *Attorney, Agent, or Firm* — Aziz M. Ahsan; Ahsan & Associates, PLLC

(57) ABSTRACT

The present invention relates generally to a cosmetic apparatus. More particularly, the invention encompasses an accessory sleeve for a cosmetic item. The present invention is also directed to a novel lock-in cosmetic accessory sleeve. The accessory sleeve has a first opening to securely and releaseably accommodate a first cosmetic container, and a second opening to securely and releaseably accommodate a second cosmetic container. Both the accessory sleeve and the containers have releaseable engagement means to securely hold each to the other.

40 Claims, 2 Drawing Sheets

LOCK-IN COSMETIC ACCESSORY SLEEVE APPARATUS

FIELD OF THE INVENTION

The present invention relates generally to a cosmetic apparatus. More particularly, the invention encompasses an accessory sleeve for a cosmetic item. The present invention is also directed to a novel lock-in cosmetic accessory sleeve. The accessory sleeve has a first opening to securely and releaseably accommodate a first cosmetic container, and a second opening to securely and releaseably accommodate a second cosmetic container. Both the accessory sleeve and the containers have releaseable engagement means to securely hold each to the other.

BACKGROUND INFORMATION

The cosmetic industry is a vibrant industry with innovations and inventions. It is a multi-billion dollar market where every new improvement not only promotes a product but also leads to other innovations. There are numerous patents that have been obtained by the innovators of this industry, however, there are always new inventions that keep this industry moving forward.

U.S. Pat. No. 4,840,511 (Joseph E. Fattori, et al.), the entire disclosure of which is incorporated herein by reference, discloses an invention comprising a roll-on applicator package having a container for storing a fluid such as a perfume or lotion or an antiperspirant or deodorant composition, an elongated roller supported on stub axles near the container top for dispensing the fluid and a resilient cap having attached therein a resilient liner for sealing the container. The resilient liner is preferably an elastomeric material and has a Durometer measurement of 20-35 Shore A.

U.S. Pat. No. 5,492,248 (Georg Ortner, et al.), the entire disclosure of which is incorporated herein by reference, discloses an invention comprising a perfume dispenser having a cylindrical shape similar to a pencil. A clip at the covering cap is broad and suitable for affixing advertising or jewelry, and may be slipped over the edge of a pocket, from which only the clip protrudes. The perfume dispenser has a delivery device including a pump, small sponge or a roll-on mechanism, which attaches to a glass cylinder. The covering cap is fastened by slipping it onto the perfume container, and a locking connection is provided between the cap and the perfume container. To compensate for tolerances, the covering cap can connect onto a metal mounting of the delivery device, for example, onto a screw cap. Alternatively, in a plug-in connection, the covering cap is provided with a slit in the edge region of a plug-in opening, or the covering cap may include a metal outer sleeve and an elastically deformable plastic inner sleeve. To improve seating of the cap, the inner sleeve includes ribs, which protrude inwards, extending in the longitudinal direction and having elastic properties.

U.S. Pat. No. 5,586,694 (Diane Breidenbach, et al.), the entire disclosure of which is incorporated herein by reference, discloses an invention comprising a perfume dispenser which is provided with a clear replaceable refill cartridge. The perfume applicator includes a metal or plastic barrel, screw on cap and disposable replaceable refill cartridge. The refill cartridge acts as the case of the unit and liquid perfume is dispensed from a snap-in spring loaded applicator, such as a roll-on applicator or an atomizer spray applicator. The disposable refill cartridge screws into the base of the barrel and a clear plug portion of refill cartridge allows viewing of the perfume level to determine when the unit is empty. The replaceable perfume cartridge preferably includes a threaded neck portion with a roller ball applicator portion therein, wherein the threaded neck portion is closed by a threaded metal cap. The replaceable perfume cartridge also preferably includes a transparent base end to provide an indication of the amount of perfume left in the cartridge, wherein further the transparent base portion is adjacent to a threaded base collar which engages a reciprocal threaded interior end of a plastic sleeve within the metal exterior barrel.

However, there is a need for improvement in the cosmetic accessories arena, and this invention improves on the deficiencies of the prior art, and provides a novel lock-in cosmetic accessory sleeve apparatus.

PURPOSES AND SUMMARY OF THE INVENTION

The invention is a novel lock-in cosmetic accessory sleeve apparatus.

Therefore, one purpose of this invention is to provide a novel lock-in cosmetic accessory sleeve apparatus.

Another purpose of this invention is to provide a reliable solution for accommodating at least two cosmetic accessories within one sleeve-type cosmetic apparatus.

Yet another purpose of this invention is to provide an easy solution for removably locking, carrying, and locating at least one cosmetic accessory.

Therefore, in one aspect this invention comprises a lock-in cosmetic accessory sleeve apparatus comprising:

(a) a lock-in cosmetic accessory sleeve having a first open end and a second open end, an inner wall, an outer wall, and at least one sleeve engageable means;

(b) a first cosmetic accessory having at least one first engageable means, said first cosmetic accessory comprising a first container, said first container having a first dispensing means for the passage of at least one first material, and wherein at least a portion of said first cosmetic accessory is releaseably secured to at least a portion of said inner wall of said lock-in cosmetic accessory sleeve through said first open end;

(c) a second cosmetic accessory having at least one second engageable means, said second cosmetic accessory comprising a second container, said second container having a second dispensing means for the passage of at least one second material, and wherein at least a portion of said second cosmetic accessory is releaseably secured to at least a portion of said inner wall of said lock-in cosmetic accessory sleeve through said second open end; and (d) wherein said at least one sleeve engageable means engages said at least one first engageable means to securely engage said first cosmetic accessory to said lock-in cosmetic accessory sleeve, and said at least one sleeve engageable means engages said at least one second engageable means to securely engage said second cosmetic accessory to said lock-in cosmetic accessory sleeve, and thereby forming said lock-in cosmetic accessory sleeve apparatus.

In another aspect this invention comprises a lock-in cosmetic accessory sleeve apparatus comprising:

(a) a lock-in cosmetic accessory sleeve having a first open end and a second open end, an inner wall, an outer wall, and at least one sleeve engageable means;

(b) a first cosmetic accessory having at least one first engageable means, said first cosmetic accessory comprising a first container and a first container cap, said first container having a first dispensing means for the passage of at least one first material, wherein said first container cap protects said first dispensing means, and wherein at least a portion of said first cosmetic accessory is releaseably secured to at least a portion of said inner wall of said lock-in cosmetic accessory sleeve through said first open end;

(c) a second cosmetic accessory having at least one second engageable means, said second cosmetic accessory comprising a second container and a second container cap, said second container having a second dispensing means for the passage of at least one second material, wherein said second container cap protects said second dispensing means, and wherein at least a portion of said second cosmetic accessory is releaseably secured to at least a portion of said inner wall of said lock-in cosmetic accessory sleeve through said second open end; and (d) wherein said at least one sleeve engageable means engages said at least one first engageable means to securely engage said first cosmetic accessory to said lock-in cosmetic accessory sleeve, and said at least one sleeve engageable means engages said at least one second engageable means to securely engage said second cosmetic accessory to said lock-in cosmetic accessory sleeve, and thereby forming said lock-in cosmetic accessory sleeve apparatus.

BRIEF DESCRIPTION OF THE DRAWINGS

Although the scope of the present invention is much broader than any particular embodiment, a detailed description of the preferred embodiment follows together with drawings. These drawings are for illustration purposes only and are not drawn to scale. Like numbers represent like features and components in the drawings. The invention may best be understood by reference to the ensuing detailed description in conjunction with the drawings in which.

DETAILED DESCRIPTION

Figure 1:
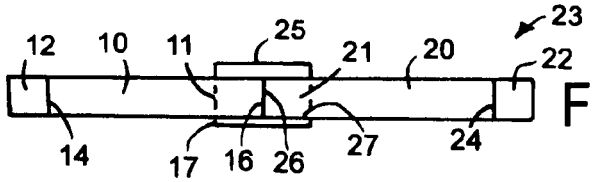
FIG. 1 illustrates a side-view of a first embodiment of a lock-in cosmetic accessory sleeve invention.

FIG. 1 illustrates a side-view of a first embodiment of a lock-in cosmetic accessory sleeve invention or apparatus 23. The lock-in cosmetic accessory sleeve invention 23, or "Fresh Kiz" 23, comprises of at least one first cosmetic accessory or container 10, which can be removably secured to at least one lock-in cosmetic accessory sleeve or carrier 25. The lock-in cosmetic accessory sleeve 25, preferably has at least one first opening 11, at a first end 17, of the lock-in cosmetic accessory sleeve 25. The lock-in cosmetic accessory sleeve 25, could also have at least one second opening 21, at a second end 27, of the lock-in cosmetic accessory sleeve 25. The lock-in cosmetic accessory sleeve invention 23, or "Fresh Kiz" 23, could also have at least one second cosmetic accessory or container 20, which can be removably secured to the at least one lock-in cosmetic accessory sleeve 25. It is preferred that the openings 11, 21, are of such a nature that they can securely accommodate the insertion and securing thereof of either the first cosmetic accessory 10, or the second cosmetic accessory 20. The first cosmetic accessory 10, preferably comprises of an open end or a first dispensing means 14, a closed end or wall 16, and a cover or cap or lid 12. The second cosmetic accessory 20, preferably comprises of an open end or a second dispensing means 24, a closed end or wall 26, and a cover or cap or lid 22. It should be appreciated that the cover or cap or lid 12, 22, could be any cover or cap or lid 12, 22, which are well-known in the art, such as, for example, a cover or cap or lid having internal threads, or having a snap-on type features, or having an internal sleeve that engages with the outer surface of the container 10, 20, to name a few.

Figure 2:
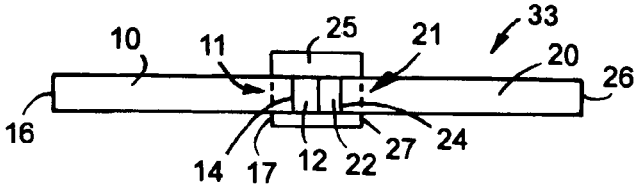
FIG. 2 illustrates a side-view of a second embodiment of a lock-in cosmetic accessory sleeve invention.

FIG. 2 illustrates a side-view of a second embodiment of a lock-in cosmetic accessory sleeve invention or apparatus 33. The lock-in cosmetic accessory sleeve invention 33, is similar to the lock-in cosmetic accessory sleeve invention 23, except that at least a portion of the cover or cap or lid 12, 22, is inside at least a portion of the lock-in cosmetic accessory sleeve 25, and is securely held therein. As one can see in this embodiment the closed end or wall 16, 26, are on the outside of the lock-in cosmetic accessory sleeve 25, and at the opposite ends.

Figure 3:
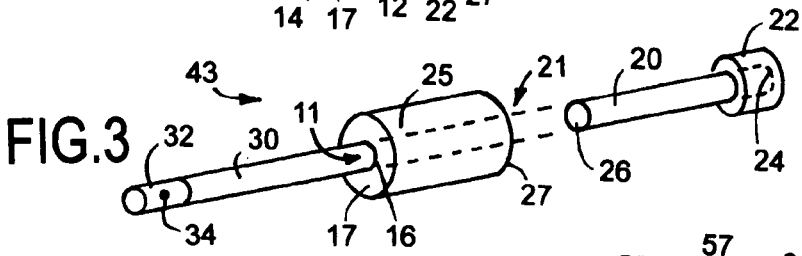
FIG. 3 illustrates an exploded perspective view of a third embodiment of a lock-in cosmetic accessory sleeve invention.
Figure 4:
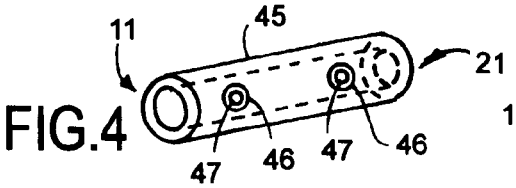
FIG. 4 illustrates a perspective view of a fourth embodiment of a lock-in cosmetic accessory sleeve invention.

FIG. 3 illustrates an exploded perspective view of a third embodiment of a lock-in cosmetic accessory sleeve invention or apparatus 43. The lock-in cosmetic accessory sleeve invention 43, is similar to the lock-in cosmetic accessory sleeve invention 23, except that the cosmetic accessory or container 30, has a fluid delivery device 34, in the cover or cap or lid portion 32. The fluid delivery device 34, could be an atomizer spray head 34, a push button type outlet nozzle 34, a spray mechanism 34, to name a few FIG. 4 illustrates a perspective view of a fourth embodiment of a lock-in cosmetic accessory sleeve invention where a lock-in cosmetic accessory sleeve 45, comprises at least one opening 46, to accommodate at least one engaging means 47. The at least one engaging means 47, could be selected from a group comprising, a ball, a ball bearing, a solid protruding material, a male-type protrusion, to name a few. It should be appreciated that the opening 46, is a through opening such that the engaging means 47, protrudes through both the inside surface or plane of the lock-in cosmetic accessory sleeve 45, as well as the outside surface or the plane of the lock-in cosmetic accessory sleeve 45. The engaging means 47, could also be a button-type lock and release 47.

Figure 5:
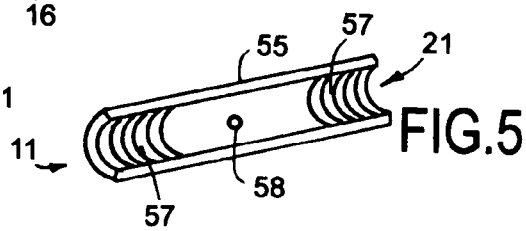
FIG. 5 illustrates a cut-away perspective view of a fifth embodiment of a lock-in cosmetic accessory sleeve invention.

FIG. 5 illustrates a cut-away perspective view of a fifth embodiment of a lock-in cosmetic accessory sleeve invention where a lock-in cosmetic accessory sleeve 55, comprises at least one engaging area 57. The at least one engaging area 57, could be internal threads 57, or internal grooves 57. The lock-in cosmetic accessory sleeve 55, could optionally have at least one opening 58, to allow for air movement, especially, for any release of air pressure when the cosmetic accessory 10, 20, is being inserted into the lock-in cosmetic accessory sleeve 55.

Figure 6:
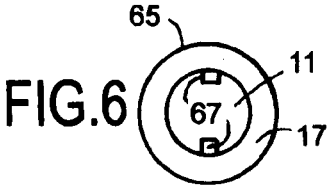
FIG. 6 illustrates an end view of a sixth embodiment of a lock-in cosmetic accessory sleeve invention.

FIG. 6 illustrates an end view of a sixth embodiment of a lock-in cosmetic accessory sleeve invention where a lock-in cosmetic accessory sleeve 65, comprises at least one engaging area 67. The at least one engaging area 67, could be at least one locking teeth 67, or at least one locking rib 67. As one can see that the cross-sectional area of the first end 17, is larger than the cross-sectional area of the first opening 11. The cross-sectional area of the opening 11, is comparable to the cross-sectional area of the first container 10, or the second container 20, as it has to be slightly bigger to accommodate the insertion of the first container 10, or the second container 20, into the first opening 11.

Figure 7:
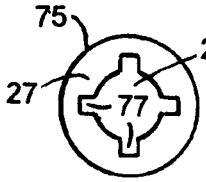
FIG. 7 illustrates an end view of a seventh embodiment of a lock-in cosmetic accessory sleeve invention.

FIG. 7 illustrates an end view of a seventh embodiment of a lock-in cosmetic accessory sleeve invention where a lock-in cosmetic accessory sleeve 75, comprises at least one engaging area 77. The at least one engaging area 77, could be at least one locking channel 77, or blind hole 77.

Figure 8:
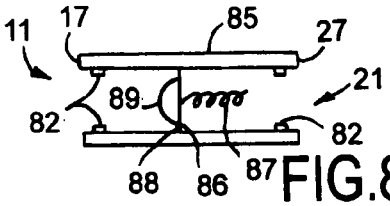
FIG. 8 illustrates a cut-away side-view of an eighth embodiment of a lock-in cosmetic accessory sleeve invention.

FIG. 8 illustrates a cut-away side-view of an eighth embodiment of a lock-in cosmetic accessory sleeve invention where a lock-in cosmetic accessory sleeve 85, comprises at least one engaging wall 86. The engaging wall 86, could have secured thereto at least one first spring 87. The engaging wall 86, could have secured thereto at least one second spring 89, such that the first spring 87, and the second spring 89, are on the opposite wall surface of the engaging wall 86. The lock-in cosmetic accessory sleeve 85, could also have at least one locking teeth or rib or bump, or protrusion 82. The wall 86, of the lock-in cosmetic accessory sleeve 85, could optionally have at least one opening 88, to allow for air movement, especially, for any release of air pressure when the cosmetic accessory 10, 20, is being inserted into the lock-in cosmetic accessory sleeve 85.

Figure 9:
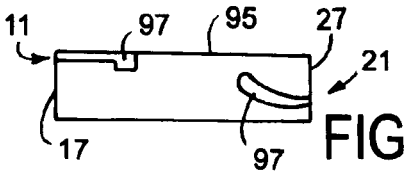
FIG. 9 illustrates a side-view of a ninth embodiment of a lock-in cosmetic accessory sleeve invention.

FIG. 9 illustrates a side-view of a ninth embodiment of a lock-in cosmetic accessory sleeve invention where a lock-in cosmetic accessory sleeve 95, comprises at least one engaging area 97. The at least one engaging area 97, could be selected from a group comprising at least one locking channel 97, a blind hole channel 97, a bayonet-type channel 97, a curved-shaped engaging channel 97, to name a few.

Figure 10:
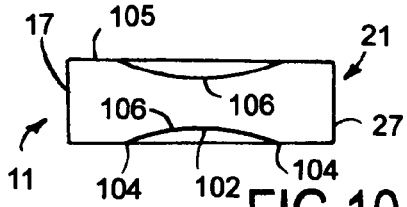
FIG. 10 illustrates a side-view of a tenth embodiment of a lock-in cosmetic accessory sleeve invention.

FIG. 10 illustrates a side-view of a tenth embodiment of a lock-in cosmetic accessory sleeve invention where a lock-in cosmetic accessory sleeve 105, comprises at least one engaging wall 106. The engaging wall 106, is shaped such that it is thickest at a first location 102, and thinner at a second location 104, where the second location 104, is closer to at least the first surface 17, or the second surface 27.

Figure 11:
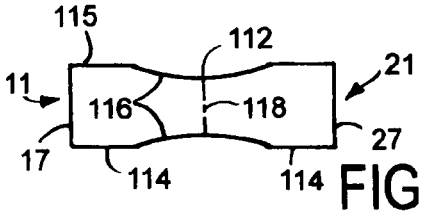
FIG. 11 illustrates a side-view of an eleventh embodiment of a lock-in cosmetic accessory sleeve invention.

FIG. 11 illustrates a side-view of an eleventh embodiment of a lock-in cosmetic accessory sleeve invention where a lock-in cosmetic accessory sleeve 115, comprises at least one engaging wall 116. The engaging wall 116, is shaped such that it has a first cross-sectional area at a first location 112, and second cross-sectional area at a second location 114, such that the first cross-sectional area 112, is different than the second cross-sectional area 114. It is preferred that the first cross-sectional area 112, is smaller than the second cross-sectional area 114. For some applications the lock-in cosmetic accessory sleeve 115, could also have at least one wall 118. It is preferred that the wall 118, is in the first cross-sectional area 112.

Figure 12:
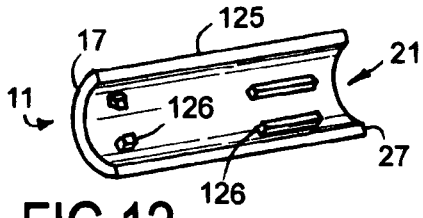
FIG. 12 illustrates a cut-away perspective view of a twelfth embodiment of a lock-in cosmetic accessory sleeve invention.

FIG. 12 illustrates a cut-away perspective view of a twelfth embodiment of a lock-in cosmetic accessory sleeve invention where a lock-in cosmetic accessory sleeve 125, comprises at least one engaging area 126. The at least one engaging area 126, could be at least one locking teeth 126, or at least one locking rib 126.

Figure 13:
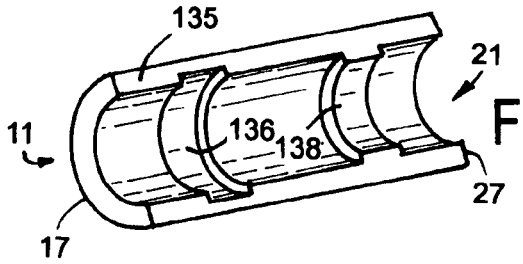
FIG. 13 illustrates a cut-away perspective view of a thirteenth embodiment of a lock-in cosmetic accessory sleeve invention.

FIG. 13 illustrates a cut-away perspective view of a thirteenth embodiment of a lock-in cosmetic accessory sleeve invention where a lock-in cosmetic accessory sleeve 135, comprises at least one first engaging area 136. The at least one first engaging area 136, could be at least one locking channel or blind hole 136. The lock-in cosmetic accessory sleeve 135, could also comprise of at least one second engaging area 138. The at least one second engaging area 138, could be at least one locking channel or locking protrusion 138.

Figure 14:
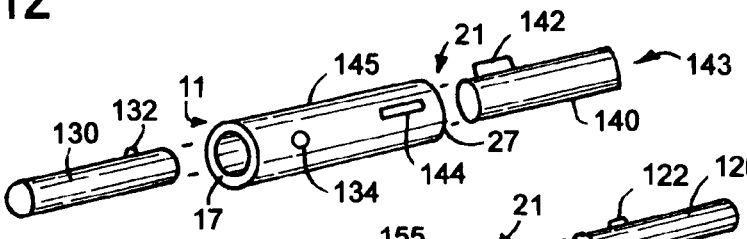
FIG. 14 illustrates an exploded perspective view of a fourteenth embodiment of a lock-in cosmetic accessory sleeve invention.

FIG. 14 illustrates an exploded perspective view of a fourteenth embodiment of a lock-in cosmetic accessory sleeve invention 143. The lock-in cosmetic accessory sleeve invention 143, is similar to the lock-in cosmetic accessory sleeve invention 23, except that the cosmetic accessory or container 130, has at least one engaging mechanism 132. The at least one engaging mechanism 132, could be selected from a group comprising an engaging protrusion 132, a ball bearing 132, a protruding surface 132, to name a few. The lock-in cosmetic accessory sleeve invention 143, could also have a second cosmetic accessory or container 140, having at least one engaging mechanism 142. The at least one engaging mechanism 142, could be selected from a group comprising an engaging protrusion 142, a teeth protrusion 142, a ribbed protrusion 142, a protruding surface 142, to name a few. The lock-in cosmetic accessory sleeve 145, could also have at least one first engaging area 134, to securely engage and accommodate the engaging mechanism 132. Similarly, the lock-in cosmetic accessory sleeve 145, could also have at least one second engaging area 144, to securely engage and accommodate the engaging mechanism 142. The engaging mechanism 132, 142, could also be a button-type lock and release mechanism 132, 142.

Figure 15:
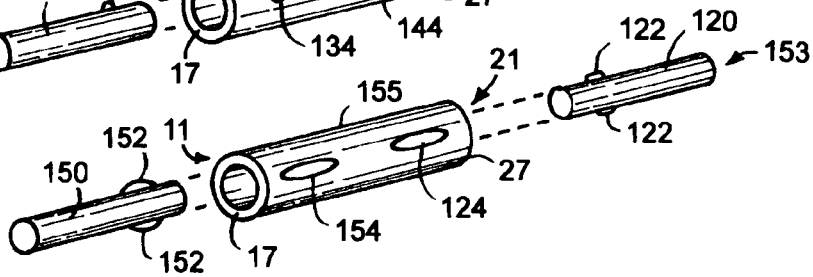
FIG. 15 illustrates an exploded perspective view of a fifteenth embodiment of a lock-in cosmetic accessory sleeve invention.

FIG. 15 illustrates an exploded perspective view of a fifteenth embodiment of a lock-in cosmetic accessory sleeve invention 153. The lock-in cosmetic accessory sleeve invention 153, is similar to the lock-in cosmetic accessory sleeve invention 23, except that the cosmetic accessory or container 150, has at least one engaging mechanism 152. The at least one engaging mechanism 152, could be selected from a group comprising an engaging spring 152, a raised strip 152, to name a few. The lock-in cosmetic accessory sleeve invention 153, could also have a second cosmetic accessory or container 120, having at least one engaging mechanism 122. The at least one engaging mechanism 122, could be selected from a group comprising an engaging protrusion 122, a wing-type protrusion 122, a wing-ribbed-type protrusion 122, to name a few. The lock-in cosmetic accessory sleeve 155, could also have at least one first engaging area 154, to securely engage and accommodate the engaging mechanism 152. Similarly, the lock-in cosmetic accessory sleeve 155, could also have at least one second engaging area 124, to securely engage and accommodate the engaging mechanism 122.

Figure 16:
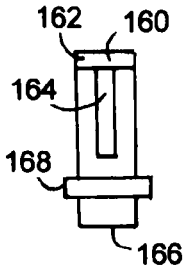
FIG. 16 illustrates a side-view of a sixteenth embodiment of a lock-in cosmetic accessory sleeve invention.

FIG. 16 illustrates a side-view of a sixteenth embodiment of a lock-in cosmetic accessory sleeve invention where a cosmetic accessory or container 160, has at least one engaging surface 168, and a base 166. The at least one engaging surface 168, could be at least one locking channel 168, or a locking protrusion 168. The cosmetic accessory or container 160, could also have a cap or cover 162, having at least one cosmetic accessory 164, secured thereto. The at least one cosmetic accessory 164, could be selected from a group comprising, a lipstick 164, an eye pencil 164, an eye liner 164, a chap stick 164, a deodorant stick 164, a perfume stick 164, to name a few.

Figure 17:
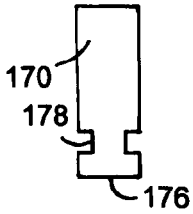
FIG. 17 illustrates a side-view of a seventeenth embodiment of a lock-in cosmetic accessory sleeve invention.

FIG. 17 illustrates a side-view of a seventeenth embodiment of a lock-in cosmetic accessory sleeve invention where a cosmetic accessory or container 170, has at least one engaging surface 178, and a base 176. The at least one engaging surface 178, could be at least one locking channel 178, or a blind channel 178, to name a few.

Figure 18:
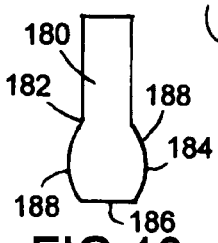
FIG. 18 illustrates a side-view of an eighteenth embodiment of a lock-in cosmetic accessory sleeve invention.

FIG. 18 illustrates a side-view of an eighteenth embodiment of a lock-in cosmetic accessory sleeve invention where a cosmetic accessory or container 180, has at least one engaging surface 188, and a base 186. The at least one engaging surface 188, is shaped such that it has a first cross-sectional area at a first location 182, and second cross-sectional area at a second location 184, such that the first cross-sectional area 182, is different than the second cross-sectional area 184. It is preferred that the first cross-sectional area 182, is smaller than the second cross-sectional area 184.

Figure 19:
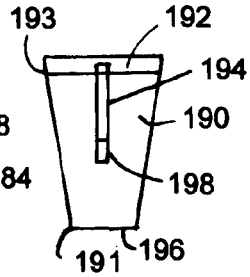
FIG. 19 illustrates a side-view of a nineteenth embodiment of a lock-in cosmetic accessory sleeve invention.

FIG. 19 illustrates a side-view of a nineteenth embodiment of a lock-in cosmetic accessory sleeve invention having a cosmetic accessory or container 190, with a base 196, where the cosmetic accessory 190, is shaped such that it has a first cross-sectional area at a first location 191, and second cross-sectional area at a second location 193, such that the first cross-sectional area 191, is different than the second cross-sectional area 193. It is preferred that the first cross-sectional area 191, is smaller than the second cross-sectional area 193. The cosmetic accessory or container 190, could also have a cap or cover 192, having at least one cosmetic support article or accessory 194, secured thereto. The at least one cosmetic support accessory 194, could also have at least one cosmetic applicator 198, secured thereto, where the cosmetic applicator 198, could be selected from a group comprising, a brush 198, a swab 198, a felt-type material 198, a scrubber 198, a to name a few.

Figure 20:
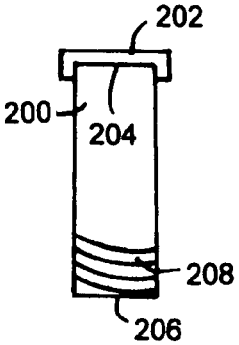
FIG. 20 illustrates a side-view of a twentieth embodiment of a lock-in cosmetic accessory sleeve invention.

FIG. 20 illustrates a side-view of a twentieth embodiment of a lock-in cosmetic accessory sleeve invention where a cosmetic accessory or container 200, has at least one engaging surface 208, and a base 206. The at least one engaging surface 208, could be at least one locking channel 208, or external threads 208, or external grooves 208. The cosmetic accessory or container 200, could also have a cap or cover 202, that can be snapably engaged to the peripheral edge or mouth 204, of the cosmetic accessory 200.

Figure 21:
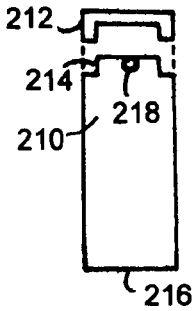
FIG. 21 illustrates an exploded side-view of a twenty-first embodiment of a lock-in cosmetic accessory sleeve invention.

FIG. 21 illustrates an exploded side-view of a twenty-first embodiment of a lock-in cosmetic accessory sleeve invention where a cosmetic accessory or container 210, has a base 216, and a cap or cover 212. The cosmetic accessory 210, could have roller 218, or a roll-on type mechanism 218, secured to the peripheral edge or mouth 214, of the cosmetic accessory or container 210. The roller 218, could be a roller-type ball 218, a cylindrical elongated roller 218, or any other similar device which can be used for dispensing fluids or material, such as, for example, cosmetic fluids or cosmetic material, from inside the container 210.

Figure 22:
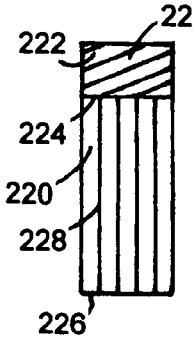
FIG. 22 illustrates a side-view of a twenty-second embodiment of a lock-in cosmetic accessory sleeve invention.

FIG. 22 illustrates a side-view of a twenty-second embodiment of a lock-in cosmetic accessory sleeve invention where a cosmetic accessory or container 220, has a base 226, and a cap or cover or lid 222. An area between the cap 222, and the container 220, defines an opening or mouth 224. The cap 222, has at least one channel or ridge 221, while the container 220, has at least one channel or ridge 228. The at least one channel or ridge 221, and/or the at least one channel or ridge 228, help in providing a non-smooth area for the easy opening and closing of the cap 222, and/or the container 220, of the lock-in cosmetic accessory 23.

Figure 23:
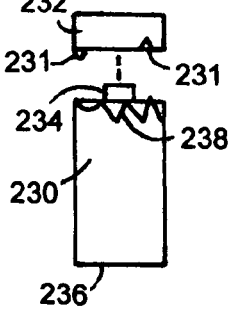
FIG. 23 illustrates an exploded side-view of a twenty-third embodiment of a lock-in cosmetic accessory sleeve invention.

FIG. 23 illustrates an exploded side-view of a twenty-third embodiment of a lock-in cosmetic accessory sleeve invention where a cosmetic accessory or container 230, has a base 236, and a cap or cover or lid 232. An area between the cap 232, and the container 230, defines an opening or mouth or dispensing means 234. The cap 232, along the peripheral portion of the cap 232, has at least one male or female engagement portion 231, while the container 230, along the peripheral portion of the container 230, has at least one male or female engagement portion 238. The male or female engagement portion 231 and 238, allow the secure engagement of the cap 232, with the container 230, around the opening 234.

It is preferred that the lock-in cosmetic accessory sleeve is made from a material selected from a group comprising, metal, plastic, glass, Plexiglas, a composite material, or any combination thereof, to name a few.

It is preferred that the cosmetic accessory is made from a material selected from a group comprising, metal, plastic, glass, Plexiglas, a composite material, or any combination thereof, to name a few. For most applications the cosmetic accessory is preferably a slender and an elongated type cosmetic accessory. For some applications the cosmetic accessory could be made from a transparent material or at least a portion of the cosmetic accessory could be transparent so that the user could visually see the material remaining inside the cosmetic accessory.

The cosmetic accessory could contain material from a group comprising, a lipstick, a lip gloss, a chap stick, a perfume, a cologne, a breath freshener, a breath spray, a deodorant, an antiperspirant, an eyeliner, an eye shadow, a cosmetic-type pencil, a shadow pencil, a concealer pencil, a liquid liner, a lip liner, a cosmetic lacquer, a mascara, a cream, a hand cream, an acne cream, a lotion, a suntan lotion, a skin lotion, a cosmetic fluid, a nail polish, a nail polish remover, a stain remover, a static guard, a blush, a powder, a mineral powder, a makeup concealer, a makeup foundation, to name a few. The cosmetic accessory could also be a hollow container which could be used as a storage container or device as desired by the user. Similarly, the cosmetic accessory could also be a refillable container or dispenser. However, for some applications the cosmetic accessory could be such that it accommodates a removable or replaceable fluid or material reservoir cartridge. For some applications the cosmetic accessory could be a pen-type insert which could be engageably or permanently inserted within a casing.

It is preferred that the lock-in cosmetic accessory sleeve apparatus is used to secure two complimentary cosmetic items within the sleeve or carrier. For example, the first cosmetic accessory 10, could be a breath spray 10, while the second cosmetic accessory 20, could be a lip gloss 20, which could both engageably be secured to the lock-in cosmetic accessory sleeve or carrier 25.

As one can now appreciate that this invention allows the easy carrying of small cosmetic accessories in a secure and engageably removable way, such as, in a purse or a pouch or in a pocket.

For some applications one could color code the lock-in cosmetic accessory sleeve and/or the containers and/or the cosmetic accessory containers. One could also use glitter and/or rhinestones with the lock-in cosmetic accessory sleeve and/or the containers and/or the cosmetic accessory containers.

The lock-in cosmetic accessory sleeve apparatus of this invention is being marketed under the brand name "Freshkiz", and is available via the website www.freshkiz.com.

The cap on the cosmetic accessory is preferably used to protect the dispensing means, however, for some applications an article could be secured to the cap such that the article secured to the cap is held inside the container, and wherein the article could be selected from a group comprising a brush, a swab, cosmetic stick, a lipstick, a lip gloss stick, a chap stick, a perfume stick, a cologne stick, a deodorant stick, an antiperspirant stick, an eyeliner, an eye shadow pencil, a cosmetic-type pencil, a shadow pencil, a concealer pencil, a liquid liner, a lip liner, a cosmetic lacquer liner, a mascara liner, a stain remover stick, and a blush stick, to name a few.

It should be appreciated that for most applications the cross-sectional area of the lock-in cosmetic accessory sleeve is larger than the cross-sectional area of the first container and/or the second container.

While the present invention has been particularly described in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

What is claimed is:

1. A lock-in cosmetic accessory sleeve apparatus comprising:

(a) a lock-in cosmetic accessory sleeve having a first open end and a second open end, an inner wall, an outer wall, and at least one first sleeve engageable means, and at least one second sleeve engageable means, and wherein said lock-in cosmetic accessory sleeve has at least one through opening between said inner wall and said outer wall to accommodate one of said first sleeve engageable means, and said second sleeve engageable means;

(b) a first cosmetic accessory having at least one first engageable spring means, said first cosmetic accessory comprising a first container, said first container having a first dispensing means for the passage of at least one first material, and wherein at least a portion of said first cosmetic accessory is releaseably secured to at least a portion of said at least one first sleeve engageable means of said lock-in cosmetic accessory sleeve through said first open end;

(c) a second cosmetic accessory having at least one second engageable spring means, said second cosmetic accessory comprising a second container, said second container having a second dispensing means for the passage of at least one second material, and wherein at least a portion of said second cosmetic accessory is releaseably secured to at least a portion of said at least one second sleeve engageable means of said lock-in cosmetic accessory sleeve through said second open end; and (d) wherein said at least one first sleeve engageable means engages said at least one first engageable spring means to securely engage said first cosmetic accessory to said lock-in cosmetic accessory sleeve, and said at least one second sleeve engageable means engages said at least one second engageable spring means to securely engage said second cosmetic accessory to said lock-in cosmetic accessory sleeve, and wherein at least a portion of one of said first engageable spring means and said second engageable spring means is securely and releaseably held by at least one of said first sleeve engageable means, and said second sleeve engageable means contained within said at least one through opening between said inner wall and said outer wall, and thereby forming said lock-in cosmetic accessory sleeve apparatus.

2. The lock-in cosmetic accessory sleeve apparatus of claim 1, wherein said first cosmetic accessory has a first cap to protect said first dispensing means.

3. The lock-in cosmetic accessory sleeve apparatus of claim 1, wherein said second cosmetic accessory has a second cap to protect said second dispensing means.

4. The lock-in cosmetic accessory sleeve apparatus of claim 1, wherein said first dispensing means are selected from a group consisting of a spray nozzle, a roller ball, and a blind hole.

5. The lock-in cosmetic accessory sleeve apparatus of claim 1, wherein said second dispensing means are selected from a group consisting of a spray nozzle, a roller ball, and a blind hole.

6. The lock-in cosmetic accessory sleeve apparatus of claim 1, wherein said first cosmetic accessory has a first cap to protect said first dispensing means, and wherein a first article is secured to said cap such that said first article secured to said cap is held inside said first container.

7. The lock-in cosmetic accessory sleeve apparatus of claim 1, wherein said second cosmetic accessory has a second cap to protect said second dispensing means, and wherein a second article is secured to said cap such that said second article secured to said cap is held inside said second container.

8. The lock-in cosmetic accessory sleeve apparatus of claim 1, wherein said first cosmetic accessory has a first cap to protect said first dispensing means, and wherein a first article is secured to said cap such that said first article secured to said cap is held inside said first container, and wherein said first article is selected from a group consisting of a brush, a swab, cosmetic stick, a lipstick, a lip gloss stick, a chap stick, a perfume stick, a cologne stick, a deodorant stick, an antiperspirant stick, an eyeliner, an eye shadow pencil, a cosmetic-type pencil, a shadow pencil, a concealer pencil, a liquid liner, a lip liner, a cosmetic lacquer liner, a mascara liner, a stain remover stick, and a blush stick.

9. The lock-in cosmetic accessory sleeve apparatus of claim 1, wherein said second cosmetic accessory has a second cap to protect said second dispensing means, and wherein a second article is secured to said cap such that said second article secured to said cap is held inside said second container, and wherein said second article is selected from a group consisting of a brush, a swab, cosmetic stick, a lipstick, a lip gloss stick, a chap stick, a perfume stick, a cologne stick, a deodorant stick, an antiperspirant stick, an eyeliner, an eye shadow pencil, a cosmetic-type pencil, a shadow pencil, a concealer pencil, a liquid liner, a lip liner, a cosmetic lacquer liner, a mascara liner, a stain remover stick, and a blush stick.

10. The lock-in cosmetic accessory sleeve apparatus of claim 1, wherein at least one of said at least one first sleeve engageable means and said at least one second sleeve engageable means is selected from a group consisting of a locking thread, a locking channel, a bayonet type channel, a locking ridge, a ball-bearing, a male-type protrusion, a female-type recess, a locking teeth, a locking rib, a locking bump, and a spring-loaded engagement means.

11. The lock-in cosmetic accessory sleeve apparatus of claim 1, wherein said at least one first engageable means is selected from a group consisting of a locking thread, a locking channel, a bayonet type channel, a locking ridge, a ball-bearing, a male-type protrusion, a female-type recess, a locking teeth, a locking rib, a locking bump, and a spring-loaded engagement means.

12. The lock-in cosmetic accessory sleeve apparatus of claim 1, wherein said at least one second engageable means is selected from a group consisting of a locking thread, a locking channel, a bayonet type channel, a locking ridge, a ball-bearing, a male-type protrusion, a female-type recess, a locking teeth, a locking rib, a locking bump, and a spring-loaded engagement means.

13. The lock-in cosmetic accessory sleeve apparatus of claim 1, wherein said first material in said first container is selected from a group consisting of a lipstick, a lip gloss, a chap stick, a perfume, a cologne, a breath freshener, a breath spray, a deodorant, an antiperspirant, an eyeliner, an eye shadow, a cosmetic-type pencil, a shadow pencil, a concealer pencil, a liquid liner, a lip liner, a cosmetic lacquer, a mascara, a cream, a hand cream, an acne cream, a lotion, a suntan lotion, a skin lotion, a cosmetic fluid, a nail polish, a nail polish remover, a stain remover, a static guard, a blush, a powder, a mineral powder, a makeup concealer, and a makeup foundation.

14. The lock-in cosmetic accessory sleeve apparatus of claim 1, wherein said second material in said second container is selected from a group consisting of a lipstick, a lip gloss, a chap stick, a perfume, a cologne, a breath freshener, a breath spray, a deodorant, an antiperspirant, an eyeliner, an eye shadow, a cosmetic-type pencil, a shadow pencil, a concealer pencil, a liquid liner, a lip liner, a cosmetic lacquer, a mascara, a cream, a hand cream, an acne cream, a lotion, a suntan lotion, a skin lotion, a cosmetic fluid, a nail polish, a nail polish remover, a stain remover, a static guard, a blush, a powder, a mineral powder, a makeup concealer, and a makeup foundation.

15. The lock-in cosmetic accessory sleeve apparatus of claim 1, wherein said lock-in cosmetic accessory sleeve is made from a material selected from a group consisting of metal, plastic, glass, Plexiglas, a composite material, and combination thereof.

16. The lock-in cosmetic accessory sleeve apparatus of claim 1, wherein said first container is made from a material selected from a group consisting of metal, plastic, glass, Plexiglas, a composite material, and combination thereof.

17. The lock-in cosmetic accessory sleeve apparatus of claim 1, wherein said second container is made from a material selected from a group consisting of metal, plastic, glass, Plexiglas, a composite material, and combination thereof.

18. The lock-in cosmetic accessory sleeve apparatus of claim 1, wherein said lock-in cosmetic accessory sleeve has at least one vertical internal wall, and wherein said at least one vertical internal wall is between said first open end and said second open end, and wherein at least one spring is secured to the surface of said at least one vertical internal wall.

19. A lock-in cosmetic accessory sleeve apparatus comprising:

(a) lock-in cosmetic accessory sleeve having a first open end and a second open end, an inner wall, an outer wall, and at least one sleeve engageable means;

(b) a first cosmetic accessory having at least one first engageable means, said first cosmetic accessory comprising a first container, said first container having a first dispensing means for the passage of at least one first material, and wherein at least a portion of said first cosmetic accessory is releaseably secured to at least a portion of said inner wall of said lock-in cosmetic accessory sleeve through said first open end;

(c) a second cosmetic accessory having at least one second engageable means, said second cosmetic accessory comprising a second container, said second container having a second dispensing means for the passage of at least one second material, and wherein at least a portion of said second cosmetic accessory is releaseably secured to at least a portion of said inner wall of said lock-in cosmetic accessory sleeve through said second open end;

(d) said lock-in cosmetic accessory sleeve having at least one vertical internal wall, and wherein said at least one vertical internal wall is between said first open end and said second open end, and wherein at least one spring is secured to the surface of said at least one vertical internal wall; and (e) wherein said at least one sleeve engageable means engages said at least one first engageable means to securely engage said first cosmetic accessory to said lock-in cosmetic accessory sleeve, and said at least one sleeve engageable means engages said at least one second engageable means to securely engage said second cosmetic accessory to said lock-in cosmetic accessory sleeve, and wherein one end of one of said first cosmetic accessory and said second cosmetic accessory engageably compresses said at least one spring when engaged inside said lock-in cosmetic accessory, and thereby forming said lock-in cosmetic accessory sleeve apparatus.

20. The lock-in cosmetic accessory sleeve apparatus of claim 19, wherein said first dispensing means are selected from a group consisting of a spray nozzle, a roller ball, and a blind hole.

21. The lock-in cosmetic accessory sleeve apparatus of claim 19, wherein said first cosmetic accessory has a first cap to protect said first dispensing means, and wherein a first article is secured to said cap such that said first article secured to said cap is held inside said first container.

22. The lock-in cosmetic accessory sleeve apparatus of claim 19, wherein said second cosmetic accessory has a second cap to protect said second dispensing means, and wherein a second article is secured to said cap such that said second article secured to said cap is held inside said second container.

23. The lock-in cosmetic accessory sleeve apparatus of claim 19, wherein said first cosmetic accessory has a first cap to protect said first dispensing means, and wherein a first article is secured to said cap such that said first article secured to said cap is held inside said first container, and wherein said first article is selected from a group consisting of a brush, a swab, cosmetic stick, a lipstick, a lip gloss stick, a chap stick, a perfume stick, a cologne stick, a deodorant stick, an antiperspirant stick, an eyeliner, an eye shadow pencil, a cosmetic-type pencil, a shadow pencil, a concealer pencil, a liquid liner, a lip liner, a cosmetic lacquer liner, a mascara liner, a stain remover stick, and a blush stick.

24. The lock-in cosmetic accessory sleeve apparatus of claim 19, wherein said second cosmetic accessory has a second cap to protect said second dispensing means, and wherein a second article is secured to said cap such that said second article secured to said cap is held inside said second container, and wherein said second article is selected from a group consisting of a brush, a swab, cosmetic stick, a lipstick, a lip gloss stick, a chap stick, a perfume stick, a cologne stick, a deodorant stick, an antiperspirant stick, an eyeliner, an eye shadow pencil, a cosmetic-type pencil, a shadow pencil, a concealer pencil, a liquid liner, a lip liner, a cosmetic lacquer liner, a mascara liner, a stain remover stick, and a blush stick.

25. The lock-in cosmetic accessory sleeve apparatus of claim 19, wherein said first material in said first container is selected from a group consisting of a lipstick, a lip gloss, a chap stick, a perfume, a cologne, a breath freshener, a breath spray, a deodorant, an antiperspirant, an eyeliner, an eye shadow, a cosmetic-type pencil, a shadow pencil, a concealer pencil, a liquid liner, a lip liner, a cosmetic lacquer, a mascara, a cream, a hand cream, an acne cream, a lotion, a suntan lotion, a skin lotion, a cosmetic fluid, a nail polish, a nail polish remover, a stain remover, a static guard, a blush, a powder, a mineral powder, a makeup concealer, and a makeup foundation.

26. The lock-in cosmetic accessory sleeve apparatus of claim 19, wherein said second material in said second container is selected from a group consisting of a lipstick, a lip gloss, a chap stick, a perfume, a cologne, a breath freshener, a breath spray, a deodorant, an antiperspirant, an eyeliner, an eye shadow, a cosmetic-type pencil, a shadow pencil, a concealer pencil, a liquid liner, a lip liner, a cosmetic lacquer, a mascara, a cream, a hand cream, an acne cream, a lotion, a. suntan lotion, a skin lotion, a. cosmetic fluid, a nail polish, a nail polish remover, a stain remover, a static guard, a blush, a powder, a mineral powder, a makeup concealer, and a makeup foundation.

27. The lock-in cosmetic accessory sleeve apparatus of claim 19, wherein said first container is made from a material selected from a group consisting of metal, plastic, glass, Plexiglas, a composite material, and combination thereof.

28. The lock-in cosmetic accessory sleeve apparatus of claim 19, wherein said second container is made from a material selected from a group consisting of metal, plastic, glass, Plexiglas, a composite material, and combination thereof.

29. A lock-in cosmetic accessory sleeve apparatus comprising:

(a) a lock-in cosmetic accessory sleeve haying a first open end and a second open end, an inner wall, an outer wall, and at least one first sleeve engageable means, and at least one second sleeve engageable means, and wherein said lock-in cosmetic accessory sleeve has at least one through opening between said inner wall and said outer wall to accommodate one of said first sleeve engageable means, and said second sleeve engageable means;

(b) a first cosmetic accessory having at least one first engageable means, said first cosmetic. accessory comprising a first container and a first container cap, said first container having a first dispensing means for the passage of at least one first material, wherein said first container cap protects said first dispensing means, and wherein at least a portion of said first cosmetic accessory is releaseably secured to at least a portion of said at least one first sleeve engageable means of said lock-in cosmetic accessory sleeve through said first open end;

(c) a second cosmetic accessory having at least one second engageable means, said second cosmetic accessory comprising a second container and a second container cap, said second container having a second. dispensing means for the passage of at least one second material, wherein said second container cap protects said second dispensing means, and wherein at least a portion of said second cosmetic accessory is releaseably secured to at least a portion of said at least one second sleeve engageable means of said lock-in cosmetic accessory sleeve through said second open end; and (d) wherein said at least one first sleeve engageable means engages said at least one first engageable means to securely engage said first cosmetic accessory to said lock-in cosmetic accessory sleeve, and said at least one second sleeve engageable means engages said at least one second engageable means to securely engage said second cosmetic accessory to said lock-in cosmetic accessory sleeve, and wherein at least a portion of one of said first engageable means and said second engageable means is securely and releaseably held by at least one of said first sleeve engageable means, and said second sleeve engageable means contained within said at least one through opening between said inner wall and said outer wall, and thereby forming said lock-in cosmetic accessory sleeve apparatus.

30. The lock-in cosmetic accessory sleeve apparatus of claim 29, wherein said first cosmetic accessory has a first cap to protect said first dispensing means.

31. The lock-in cosmetic accessory sleeve apparatus of claim 29, wherein said second cosmetic accessory has a second cap to protect said second dispensing means.

32. The lock-in cosmetic accessory sleeve apparatus of claim 29, wherein said first dispensing means are selected from a group consisting of a spray nozzle, a roller ball, and a blind hole.

33. The lock-in cosmetic accessory sleeve apparatus of claim 29, wherein said first cosmetic accessory has a first cap to protect said first dispensing means, and wherein a first article is secured to said cap such that said first article secured to said cap is held inside said first container, and wherein said first article is selected from a group consisting of a brush, a swab, cosmetic stick, a lipstick, a lip gloss stick, a chap stick, a perfume stick, a cologne stick, a deodorant stick, an antiperspirant stick, an eyeliner, an eye shadow pencil, a cosmetic-type pencil, a shadow pencil, a concealer pencil, a liquid liner, a lip liner, a cosmetic lacquer liner, a mascara liner, a stain remover stick, and a blush stick.

34. The lock-in cosmetic accessory sleeve apparatus of claim 29, wherein said second cosmetic accessory has a second cap to protect said second dispensing means, and wherein a second article is secured to said cap such that said second article secured to said cap is held inside said second container, and wherein said second article is selected from a group consisting of a brush, a swab, cosmetic stick, a lipstick, a lip gloss stick, a chap stick, a perfume stick, a cologne stick, a deodorant stick, an antiperspirant stick, an eyeliner, an eye shadow pencil, a cosmetic-type pencil, a shadow pencil, a concealer pencil, a liquid liner, a lip liner, a cosmetic lacquer liner, a mascara liner, a stain remover stick, and a blush stick.

35. The lock-in cosmetic accessory sleeve apparatus of claim 29, wherein at least one of said at least one first sleeve engageable means and said at least one second sleeve engageable means is selected from a group consisting of a locking thread, a locking channel, a bayonet type channel, a locking ridge, a ball-bearing, a male-type protrusion, a female-type recess, a locking teeth, a locking rib, a locking, bump, and a spring-loaded engagement means.

36. The lock-in cosmetic accessory sleeve apparatus of claim 29, wherein said first material in said first container is selected from a group consisting of a lipstick, a lip gloss, a chap stick, a perfume, a cologne, a. breath freshener, a. breath spray, a deodorant, an antiperspirant, an eyeliner, an eye shadow, a cosmetic-type pencil, a shadow pencil, a concealer pencil, a liquid liner, a lip liner, a cosmetic lacquer, a mascara, a cream, a hand cream, an acne cream, a lotion, a suntan lotion, a skin lotion, a cosmetic fluid, a nail polish, a nail polish remover, a stain remover, a static guard, a blush, a powder, a mineral powder, a makeup concealer, and a makeup foundation.

37. The lock-in cosmetic accessory sleeve apparatus of claim 29, wherein said second material in said second container is selected from a group consisting of a lipstick, a lip gloss, a chap stick, a perfume, a cologne, a breath freshener, a breath spray, a deodorant, an antiperspirant, an eyeliner, an eye shadow, a cosmetic-type pencil, a shadow pencil, a concealer pencil, a liquid liner, a lip liner, a cosmetic lacquer, a mascara, a cream, a hand cream, an acne cream, a lotion, a suntan lotion, a skin lotion, a cosmetic fluid, a nail polish, a nail polish remover, a stain remover, a static guard, a blush, a powder, a mineral powder, a makeup concealer, and a makeup foundation.

38. The lock-in cosmetic accessory sleeve apparatus of claim 29, wherein said first container is made from a material selected from a group consisting of metal, plastic, glass, Plexiglas, a composite material, and combination thereof.

39. The lock-in cosmetic accessory sleeve apparatus of claim 29, wherein said second container is made from a material selected from a group consisting of metal, plastic, glass, Plexiglas, a composite material, and combination thereof.

40. The lock-in cosmetic accessory sleeve apparatus of claim 29, wherein said lock-in cosmetic accessory sleeve has at least one vertical internal wall, and wherein said at least one vertical internal wall is between said first open end and said second open end, and wherein at least one spring is secured to the surface of said at least one vertical internal wall.

* * * * *